United States Patent [19]

Wechselberger et al.

[11] Patent Number: 4,938,460

[45] Date of Patent: Jul. 3, 1990

[54] APPARATUS FOR AIR QUENCHING RAILWAY HEADS

[75] Inventors: Emmerich E. Wechselberger, Glen Ellyn; Ralph S. Frost, Olympic Fields, both of Ill.

[73] Assignee: Chemetron-Railway Products, Inc., Wheeling, Ill.

[21] Appl. No.: 27,766

[22] Filed: Mar. 19, 1987

[51] Int. Cl.[5] ..... C21D 9/04

[52] U.S. Cl. ..... 266/258; 266/251; 266/259; 266/249

[58] Field of Search ..... 266/114, 134, 249, 251, 266/259

[56] References Cited

U.S. PATENT DOCUMENTS 4,611,789 9/1986 Ackert et al. ..... 266/134

FOREIGN PATENT DOCUMENTS 186373 7/1986 European Pat. Off. ..... 148/146
978312 12/1964 Fed. Rep. of Germany ..... 266/134
657883 4/1979 U.S.S.R. ..... 148/146

*Primary Examiner*—John P. Sheehan
*Assistant Examiner*—Margery S. Phipps
*Attorney, Agent, or Firm*—Welsh & Katz, Ltd.

[57] ABSTRACT

Air quenching apparatus develops a pearlite microstructure in the head of a longitudinally travelling railroad rail as it travels under the apparatus. A primary air chamber at a controlled pressure provides air to the top and side surfaces of the rail heads. A secondary air chamber at a separately controlled pressure provides air to the shoulders of the rail heads. More than one quench unit may be used in series, in which case the pressures in the primary air chambers may progressively increase to increase the cooling rate.

13 Claims, 2 Drawing Sheets

APPARATUS FOR AIR QUENCHING RAILWAY HEADS

This invention relates to air quenching apparatus for hardening the heads of railway rails to enhance their wear resistance. As the technical literature summarized in U.S. Pat. No. 4,611,789 indicates, the best combination of wear hardness and certain other mechanical properties in rail heads are achieved by a fine pearlite microstructure. As this patent also indicates, such a microstructure may be developed by heating the heads of an axially moving rail to austenizing temperatures and then quenching the heads with air or other cooling means but not so rapidly as to develop hard martensite or bainite in the microstructure.

Until recently, rails having a nominal minimum head hardness of 248 Brinell was the standard rail in the industry. The chemistry of these rails was such that rails could be quenched with little risk of developing significant amounts of martensite. As loads and speeds have increased however, the industry has specified more wear resistant rails. Thus, rails having a nominal head hardness of 300 Brinell are now specified as standard. The chemistry of 300 BHN rails is such that the quenching operation must be very carefully controlled to avoid overquenching the head to form martensite. In addition, the hardness distribution pattern developed in the rail head must meet industry standards. Thus, the surface hardness of the rail head must be between 346 and 393 BHN, with 388 being desired; the 321 BHN hardness line must be at least 9/16" from the shoulder of the head and ½" from top center; and the hardness must decrease uniformly from the surface to the interior.

The air quenching unit of the present invention enables very close control of the quenching step. Standard 300 BHN rail strings may be hardened which contain little, if any, martensite or bainite and meet the requirements of the industry. The unit has produced such rail at line speeds of up to about 24 inches/minute. The unit has a perforated plate with a concave surface for confronting the top and side surfaces of the rail head as the rail is axially driven under the unit. A primary air chamber in air-flow communication with the portions of the perforated plate confronting the top and side surfaces of the rail head and a means for supplying air to the primary chamber at a controlled pressure provides a controlled amount of air to those surfaces of the rail head. A secondary air chamber in air-flow communication with the portion of the perforated plate confronting the rail head shoulders and a means for supplying air to the secondary chamber at a controlled pressure provides a controlled amount of air to the shoulders of the head independently of the air provided to the other surfaces. This multichambered structure enables the shoulders of the rail heads to be cooled somewhat independently of the top and side surfaces of the heads. This is desirable because there is a substantial risk of martensite or bainite formation (in certain alloys) at the shoulders where the relatively large (local surface area)/ (local mass) ratio in the shoulder zone tends to result in faster cooling. Preferably, two or more air quenching units of the present invention are spaced apart and the air pressure in the secondary chamber is such that the secondary air flow rate is not more than about 75% of the air flow rate from the primary chamber. This configuration enables a large amount of quench air to escape between the quench units rather than along side the units, which further facilitates controlled cooling of the shoulders.

Other details, objects and advantages of the invention will become apparent as the following description of a present preferred embodiment thereto proceeds.

In the accompanying drawings, a present preferred embodiment of the invention is shown in which:

DETAILED DESCRIPTION

Figure 1:
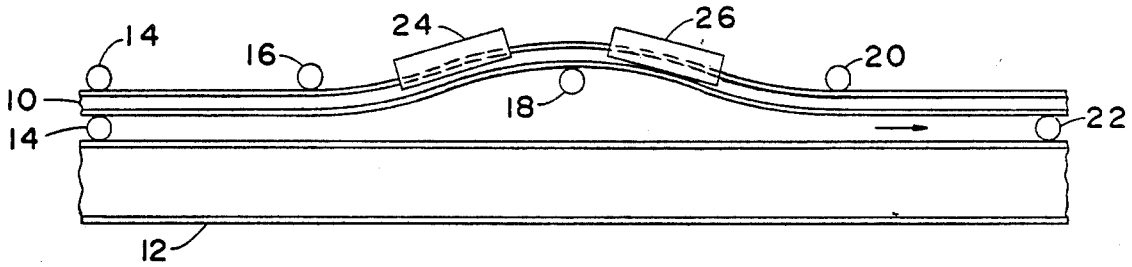
FIG. 1 schematically illustrates a rail head hardening plant in which the air quenching unit of the present invention may be utilized.

FIG. 1 illustrates a well known type of rail hardening plant (shown in, e.g., U.S. Pat. Nos. 4,611,789 and 3,276,924 and in Canadian Pat. No. 888,671) wherein a rail string 10 is driven over a stationary base frame 12 by drive rolls 14. The rail 10 is constrained against crowning by rolls 16, 18, 20 and 22 when the rail head is first heated to austenizing temperatures of about 1950° F. by an induction heater 24 and then quenched by a quench unit 26 to develop a fine pearlite microstructure in the head.

Figure 2:
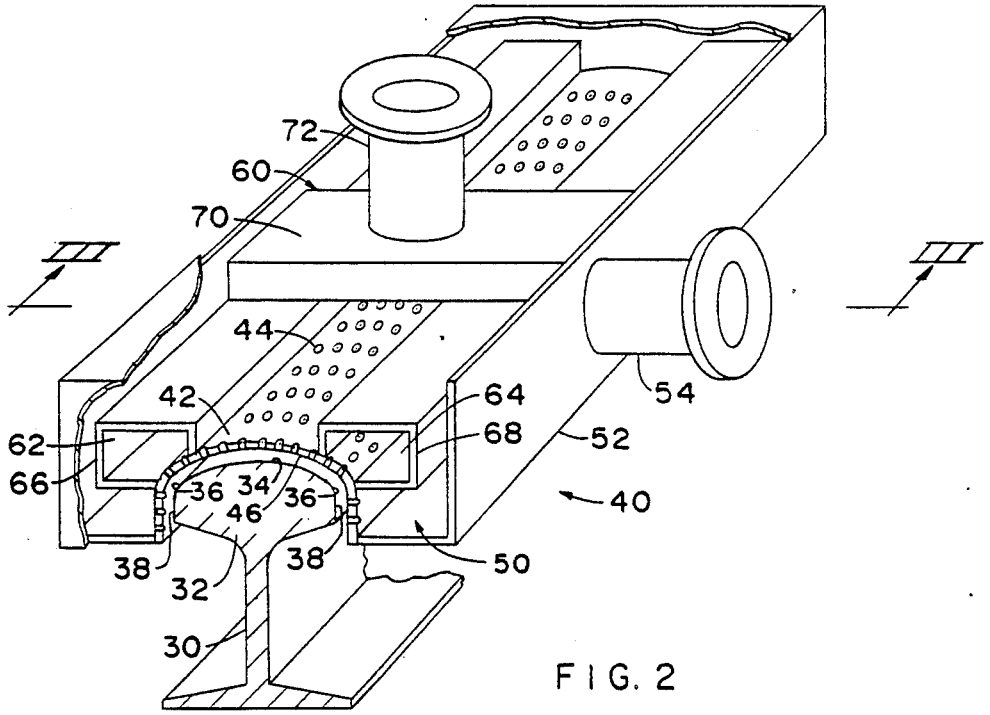
FIG. 2 is a perspective partially fragmentary view of the air quenching unit of the present invention above a rail shown in cross section.
Figure 3:
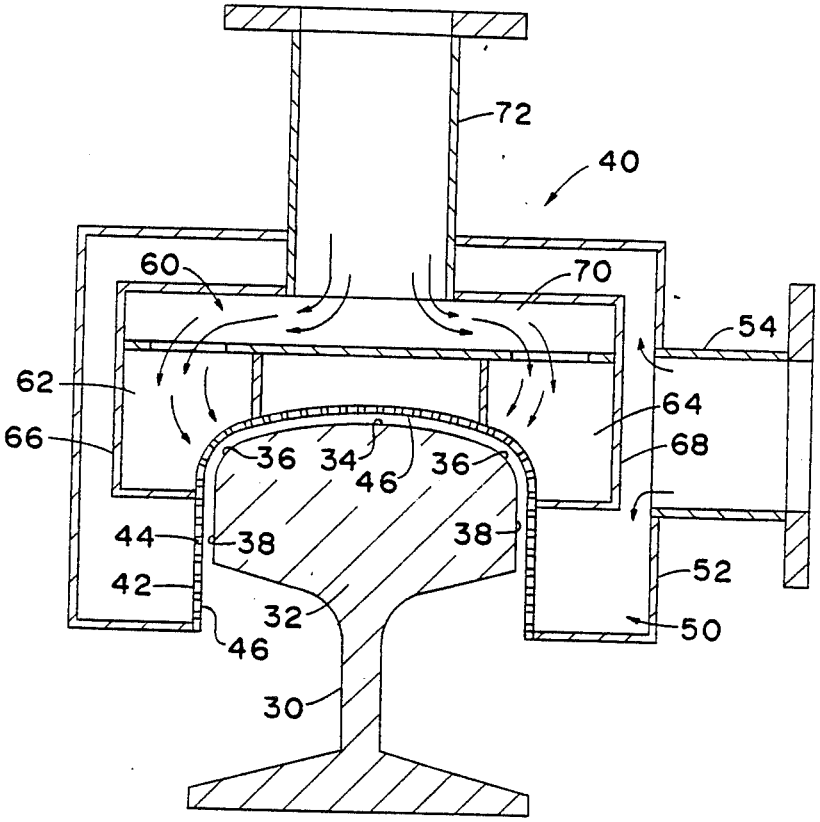
FIG. 3 is a cross sectional view of the air quenching unit of FIG. 2 taken along section line III—III.

A preferred embodiment of the air quench unit of the present invention is most clearly seen in FIGS. 2 and 3. The quench unit 40 is operative to effect quenching by a quenching fluid, such as air, and is shown positioned over a rail 30 having a head portion 32. The surfaces of the rail head 32 which must be hardened are its top surface comprising the running surface 34 on which the wheels of the trains actually ride, shoulder surfaces 36 alongside the running surface, and side surfaces 38. The quench unit 40 comprises a curved plate 42 with perforations 44 having a concave surface 46 for confronting the top and side surfaces of the head. The perforations may be orifices as shown or alternatively elongated holes. Preferably, the orifices are no larger than about ⅛ inch in diameter. The orifices may have the same or different diameters and may be disposed on the same or different centers depending upon rail chemistry, line speed and available air pressure. It is also preferred that the distance between the plate 42 and the rail head 32 be about 3/16 inch and no more than ¼ inch (where the heat transfer coefficient is generally acceptable) as the heat transfer improves by a factor of 10 when the distance is reduced from about ½ inch or more to 3/16 inch.

A primary air quenching fluid chamber 50 is generally defined by the perforated plate 42 and a housing 52 welded thereto. A flanged nozzle 54 is welded to the side of the housing. An air line 56 having an in-line pressure regulating valve 58 (shown in FIG. 4) or other pressure control means may be connected between an air supply header 80 and the nozzle 54 for supplying cooling fluid, such as air to the primary chamber 50.

A secondary air quenching fluid chamber 60 is disposed within the primary air chamber 50 for providing air to the shoulders of the rail heads. The secondary air chamber generally comprises two passageways 62 and 64 defined by the portions of the perforated plate 42 confronting the shoulders of the rail head and headers 66 and 68 welded thereto and interconnected by a cross header 70. A flanged nozzle 72 extends from the cross header 70 through the top of the housing 52 for connection to an air line 74 having an in-line pressure regulating valve 76 or other pressure control means for providing air from an air supply header 80 at a controlled pressure. If there is a risk of martensite formation, the pressure in the secondary air chamber is maintained below the pressure in the primary air chamber. In the preferred embodiment, the primary air nozzle 54 faces a header 68 to baffle and distribute the primary air in the primary air chamber so that air from the air lines does not directly impinge on the rail head. This arrangement also enables the use of relatively long quench units having a plate length parallel to the rail heads which is longer than the length of the plate perpendicular to the rail head.

Figure 4:
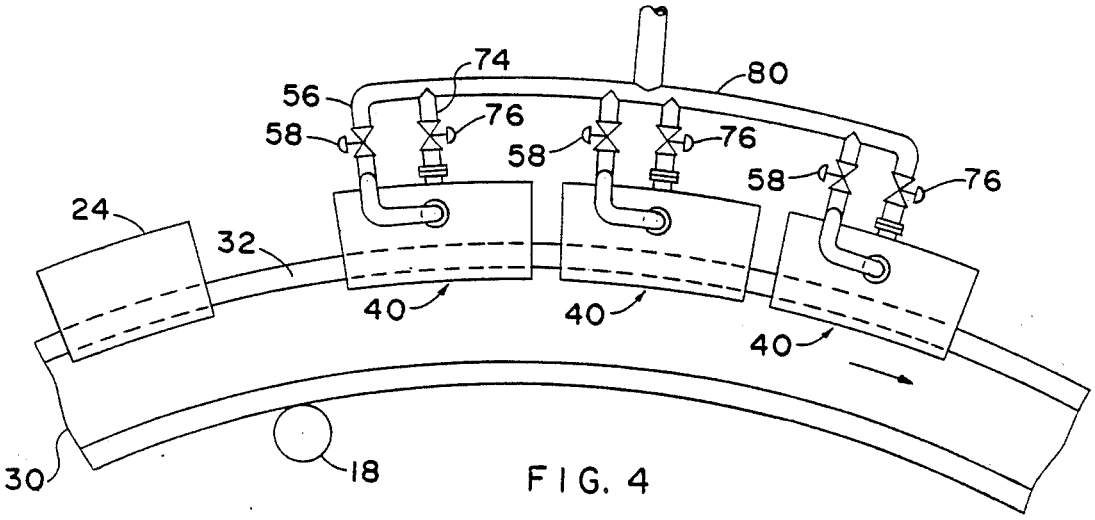
FIG. 4 schematically illustrates the use of three of the quenching units shown in FIGS. 2 and 3.

FIG. 4 illustrates a preferred embodiment of the invention wherein three spaced apart air quench units 40 are utilized to quench the head of a rail being driven below at high speeds. The use of a plurality of quenching units enables the various zones to be transversely subdivided and each subzone individually controlled. Control may be enhanced by spacing the quench units one from the other so that large portions of the quench air from one unit may escape at the ends of the quench unit rather than along its sides. Alternatively, units may not be spaced in cases where such an air flow pattern is not needed. In a test of the embodiment of FIG. 4, three quenching units were operated at primary air pressures of about 5, 6 and 50 psig in the leading, second and third quench units with the secondary air flow rate at about 75% of the primary air flow rate and very good head hardened 300 BHN rails were produced at line speeds of about 24 inches/minute. The use of a plurality of units in series over the rail heads and progressively increasing the cooling rates of the units allows the rail head to be heated in layers so that the rail surface is not quenched too quickly (thus forming bainite or martensite) and/or the rail interior is not quenched too slowly (forming coarse pearlite).

While a present preferred embodiment of the invention has been shown and described, it is to be distinctly understood that the invention is not limited thereto but may be otherwise variously embodied within the scope of the following claims.

What is claimed is:

1. Apparatus for fluid quenching the head of an axially moving railway rail from austenizing temperatures to develop a pearlite microstructure in the head, said rail head defining a top running surface, laterally opposite side surfaces, and a shoulder surface between each side surface and said top running surface, said apparatus comprising a plurality of substantially longitudinally aligned and spaced apart quench units, each quench unit including:

a perforated plate having a concave surface for confronting the top, shoulder and side surfaces of the rail head when passed through the quench unit;

first housing means cooperative with said plate to define a primary fluid chamber in fluid-flow communication with perforations in said plate confronting only the top running surface and side surfaces of the rail head;

first fluid supply means for supplying cooling fluid to said primary fluid chamber at a first predetermined pressure;

second housing means defining a pair of secondary fluid chambers discrete from said primary fluid chamber and in fluid-flow communication with perforations in the plate confronting only the shoulder surfaces of the rail head; and second fluid supply means for supplying fluid to said secondary fluid chambers at a second pressure less than the first pressure;

and pressure control means operatively associated with each of said first and second fluid supply means and operative to introduce fluid pressure into the primary fluid chambers of successive quench units in a manner to effect a progressively more rapid cooling rate in each successive primary fluid chamber, said pressure control means being further operative to introduce fluid pressure into the secondary fluid chambers of each successive quench unit to effect a lower rate of cooling of the shoulder surfaces than the top and side surfaces within the corresponding quench unit.

2. The apparatus of claim 1 comprising three spaced apart quench units.

3. The apparatus of claim 1 wherein the distance between the perforated plates of the quench units and the rail head is not greater than about ¼ inch.

4. The apparatus as defined in claim 3 wherein the fluid pressure in the primary chambers is progressively increased from the first to the last primary chamber in the successive quench units.

5. Apparatus for air quenching the head of a longitudinally moving railway rail from austenizing temperatures to develop a pearlite microstructure in the head, said rail head defining a longitudinal top running surface, laterally opposite longitudinal side surfaces, and a shoulder surface between each side surface and said top running surface, said apparatus comprising:

a perforated elongated plate having a longitudinal axis and a concave surface curved about said longitudinal axis for confronting the top, shoulder and side surfaces of the rail head when passed longitudinally through the apparatus in predetermined spaced relation to said concave surface;

first housing means cooperative with said plate to define a primary air chamber extending generally longitudinally of said plate in air-flow communication with perforations in said perforated plate confronting only the top running surface and the side surfaces of the rail head;

first air supply means for supplying air to said primary air chamber at a controlled pressure so as to cause air to impinge said top running surface and said side surfaces of said rail head;

second housing means defining a pair of discrete secondary air chambers extending generally longitudinally of said plate in air-flow communication with perforations in said perforated plate confronting only the shoulder surfaces of the rail head; and second air supply means for supplying air to said secondary air chambers at a controlled pressure so as to cause air to impinge said shoulder surfaces of said rail head;

said first and second air supply means enabling varying of the air pressure within said primary and secondary air chambers in a manner to effect different cooling rates for the rail head surfaces confronted by said primary and secondary air chambers during longitudinal movement of the rail through the apparatus in said predetermined spaced relation to said perforated concave surface.

6. Apparatus as defined in claim 1 including a header interconnecting said secondary air chambers and having nozzle means adapted for connection to said second air supply means.

7. Apparatus as defined in claim 6 including pressure regulating means operatively connected to said nozzle means to enable control of air pressure from said second air supply means to said secondary air chambers.

8. The apparatus as defined in claim 1 wherein the perforated plate has a longitudinal length parallel to the rail head and a transverse width transverse to the rail head, said longitudinal length being greater than said transverse width.

9. Apparatus as defined in claim 1 wherein said perforated plate defines a plurality of generally circular flow orifices therethrough of not greater than about one-eighth inch diameter.

10. Apparatus as defined in claim 1 wherein said perforated plate is spaced from the top running surface, shoulder and side surfaces of the rail head a distance no greater than approximately one-fourth inch.

11. Apparatus as defined in claim 1 wherein said second housing means is disposed within said first housing means.

12. Apparatus as defined in claim 1 wherein said second housing means defines baffle means, said first air supply means being operative to introduce air into said primary fluid chamber so as to impinge said baffle means and thereby pass the air indirectly to the perforations confronting the top and side surfaces of a rail head when passed through the apparatus.

13. Apparatus as defined in claim 1 wherein said second means for supplying air to said secondary fluid chambers is operative to effect discharge from the perforations confronting said shoulder surfaces at a rate less than 75% of the rate of air discharge from the perforations confronting the top and side surfaces of a rail head when passed through the apparatus.

* * * * *

UNITED STATES PATENT AND TRADEMARK OFFICE

CERTIFICATE OF CORRECTION

PATENT NO. : 4,938,460

DATED : July 3, 1990

INVENTOR(S) : Emmerich E. Wechselberger and Ralph S. Frost

It is certified that error appears in the above-identified patent and that said Letters Patent is hereby corrected as shown below:

ON TITLE PAGE: Item [75] inventor Frost should be --Olympia Fields-- IL.

Column 4, line 25, "claim 3" should be --claim 1--.

Column 5, line 1, "claim 1" should be --claim 5--.

Column 5, line 9, "claim 1" should be --claim 5--.

Column 5, line 14, "claim 1" should be --claim 5--.

Column 5, line 19, "claim 1" should be --claim 5--.

Column 6, line 3, "claim 1" should be --claim 5--.

Column 6, line 6, "claim 1" should be --claim 5--.

Column 6, line 9, "fluid" should be --air--.

Column 6, line 13, "claim 1" should be --claim 5--.

Column 6, line 14, "fluid" should be --air--.

Signed and Sealed this

Twenty-third Day of June, 1992

*Attest:*

DOUGLAS B. COMER

*Attesting Officer*

*Acting Commissioner of Patents and Trademarks*